US006568202B1

(12) United States Patent
Hodges

(10) Patent No.: US 6,568,202 B1
(45) Date of Patent: May 27, 2003

(54) PORTABLE AIR CONDITIONER

(76) Inventor: Sam Hodges, 4924 Cobbs Dr., #4G, Waco, TX (US) 76710

( * ) Notice: Subject to any disclaimer, the term of this patent is extended or adjusted under 35 U.S.C. 154(b) by 0 days.

(21) Appl. No.: 10/033,963

(22) Filed: Jan. 3, 2002

Related U.S. Application Data

(60) Provisional application No. 60/259,905, filed on Jan. 8, 2001.

(51) Int. Cl.[7] ..... B01F 3/04; F28D 5/00

(52) U.S. Cl. ..... 62/306; 62/314; 261/121.1

(58) Field of Search ..... 62/306, 307, 314; 261/121.1

(56) References Cited

U.S. PATENT DOCUMENTS 1,898,603 A * 2/1933 Stubkjare ..... 261/104
2,157,519 A * 5/1939 Beeman ..... 261/140.1
2,307,422 A * 1/1943 Richards ..... 165/50
2,777,677 A * 1/1957 Bunch ..... 261/158
2,970,456 A * 2/1961 Rice ..... 62/244
3,961,496 A 6/1976 Ku ..... 62/459
4,953,831 A * 9/1990 Albrecht ..... 261/102
5,046,329 A 9/1991 Travis, III ..... 62/259.3
5,168,722 A * 12/1992 Brock ..... 62/304
5,197,301 A 3/1993 Holcomb ..... 62/457.1
5,685,165 A 11/1997 Bigelow, Jr. ..... 62/420
5,715,698 A * 2/1998 Calton ..... 62/309

* cited by examiner

*Primary Examiner*—William E. Tapolcai
(74) *Attorney, Agent, or Firm*—Patent & Trademark Services, Inc.; Thomas Zack; Joseph H. McGlynn

(57) ABSTRACT

A portable air conditioner which has a container for holding an air cooling medium, a lid for the container and a plurality of outlets in the lid which permit flexible conduits to connected to the output from the lid. In addition, a cart is disclosed for transporting the air conditioner which will keep the top and bottom of the container parallel in order to keep any liquid from melting ice from spilling.

3 Claims, 4 Drawing Sheets

PORTABLE AIR CONDITIONER

This invention claims the benefit of the U.S. Provisional application No. 60/259,905 filed on Jan. 8, 2001.

BACKGROUND OF THE INVENTION

The present invention relates to a portable air conditioner that has a container with a lid for holding a cooling medium A plurality of outlets in the lid allow flexible hoses to be connected to the lid to assist in distributing the cooled air to a desired location.

Portable air conditioning units are known to the prior art. For example, such unit includes a container, a lid, a cooling medium and a battery operated fan and a water circulation conduit. Another invention discloses a portable air conditioning unit with a battery operated fan and a cooling medium.

Another portable air conditioner is known to have a container with a lid, a cooling medium and a battery operated fan that blows air through a separate compartment that holds the cooling medium.

There are also other units made up of a container, a lid, a cooling medium and a battery operated fan.

DESCRIPTION OF THE PRIOR ART

Portable air conditioner units are disclosed in a variety of configurations and sizes in the prior art. For example, U.S. Pat. No. 3,961,495 to Ku discloses an air conditioner that has a container, a lid, a cooling medium and a battery operated fan and a water circulation conduit.

U.S. Pat. No. 5,046,329 to Travis, III discloses a portable air conditioning unit that has a battery operated fan and a cooling medium.

U.S. Pat. No. 5,197,301 to Holcomb discloses a portable air conditioner which has a container, a lid, a cooling medium and a battery operated fan that blows air through a separate compartment from the compartment that holds the cooling medium.

U.S. Pat. No. 5,685,165 to Biglow, Jr. discloses an air conditioner with a container, a lid, a cooling medium and a battery operated fan.

In the present invention a portable air conditioner has a container for holding a cooling medium, such as ice, a lid for the container and a plurality of outlets in the lid which permit flexible conduits to be connected to the output from the lid, all as will be detailed in the specification that follows hereafter.

SUMMARY OF THE INVENTION

This invention relates to a portable air conditioner which has a container for holding an air cooling medium, a lid for the container and a plurality of outlets in the lid which permit flexible conduits to connected to the output from the lid. In addition, a cart is disclosed for transporting the air conditioner which will keep the top and bottom of the container parallel in order to keep any liquid, from melting ice, from spilling.

The present invention is primarily designed to give one or more athletes, who rotate out of a game, or event, heat/stress relief. The present invention provides such persons easy access to a supply of cool and moist air of sufficient velocity and volume to provide a controlled level and rate of cool down so they may rotate back into the game at a high level of efficiency.

However, the present invention is not limited to use solely by athletes. It could also be used by persons engaged in any high rate of activity or normal rate of activity in a high temperature environment. It would especially be useful to persons engaged in a high rate activity in a hot environment. It would provide a temporary rest and/or heat/stress relief before resuming their activities.

The present invention is easily portable, uses an inexpensive, readily available, safe cooling medium and can be powered by inexpensive, rechargeable 12 Volt batteries (gel or wet).

It is the primary object of the present invention to provide for an improved portable air conditioning unit whose air output can be transported easily to a desired location.

Another object is to provide for such a unit wherein a cooling medium is located within a container having a lid with a plurality of outlets and flexible conduits are connected to one or more of these outlets to direct the air, as desired, by a user.

Another object is to provide for such a unit a cart for transporting the air conditioner.

Another object is to provide a supply of cooled air that is not at a maximum cold temperature with reduced volume and pressure.

These and other objects and advantages of the present invention will become apparent to readers from a consideration of the ensuing description and the accompanying drawings.

DESCRIPTION OF THE PREFERRED EMBODIMENT

Figure 1:
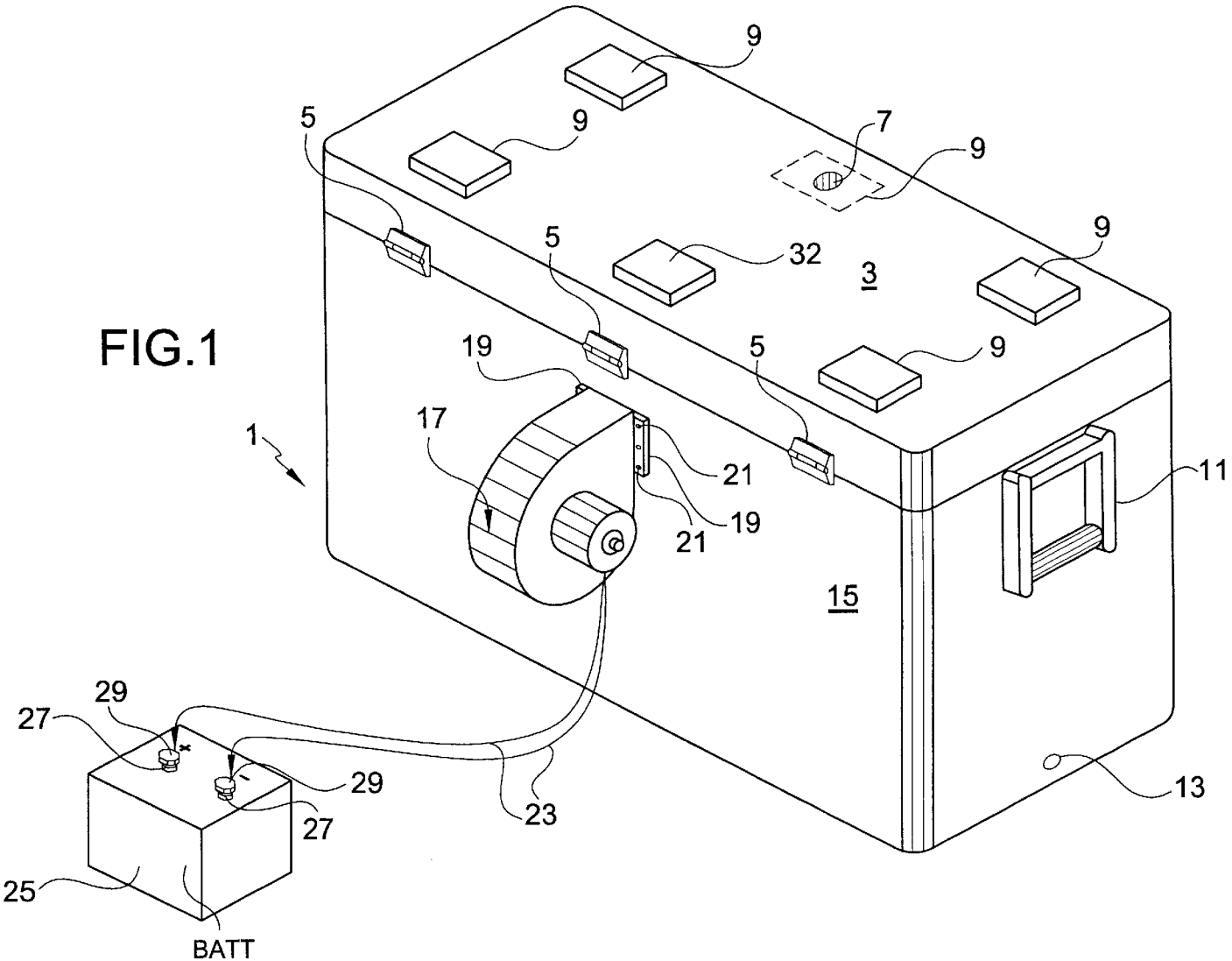
FIG. 1 is a perspective view of the present invention without any conduits attached.

FIG. 1 is a perspective view of the present invention without any air outlet conduits attached to the container 1. The container is closed on all sides and the bottom, but has a top which can be opened. A lid 3 is shown closing the top of the container 1. Three aligned hinges 5 on one container side mount the lid 3 to the container 1, and permit the opening and closing of the container top by lifting the lid. An uncovered or opened outlet 7 , in lid 3, is shown for explanatory purposes, however, it is to be understood that the outlet 7 is normally covered by a discharge port cover such as the cover 9. Covers 9 are shown covering the other five lid outlets which are the same as outlet 7.

The cover 9 for outlet 7 is shown in dotted line format over the outlet. Each separate cover 9 is biased to a normally closed position by a hinge spring, as best shown in FIG. 3. As explained with respect to FIG. 2, one or more of the covers 9 for the outlets may be opened to connect a hose 31 to the outlets. There is also a container side outlet nearest the fan 17 that has a cover which can be opened. Both ends of the container 1 also have carrying handles 11 such as are found on ice chests, etc. At least one lower drainage hole 13 is located on the side of container 1. Hole 13 extends into the interior of the container to allow melted liquids, like ice-water, to be discharged from the container.

Mounted to the container back wall 15 is a conventional electrically operated fan 17. A surrounding flat flange 19 extends parallel to the back wall 15 and goes around a wall opening in the container 1. Flange engaging screws, or other fasteners, 21 extend through the flange and into the back wall of the container 15. The fasteners 21 hold the fan 17 to the container front wall 15 to mount the fan to a wall outlet (not shown, see FIG. 4) located directly behind the fan 17. The wall outlet leads to the insulated interior of the container 1.

Wires 23 are used to connect the fan 17 to a self-contained electrical power source, shown here as the battery 25. Two color coded battery clips 27 are fixed to the free ends of the wires 23 and engage the positive and negative terminals 29 of the battery. When it is desired to turn the fan 17 off, at least one of the fan wires 23 would be disconnected from the terminal of the battery 25.

Figure 2:
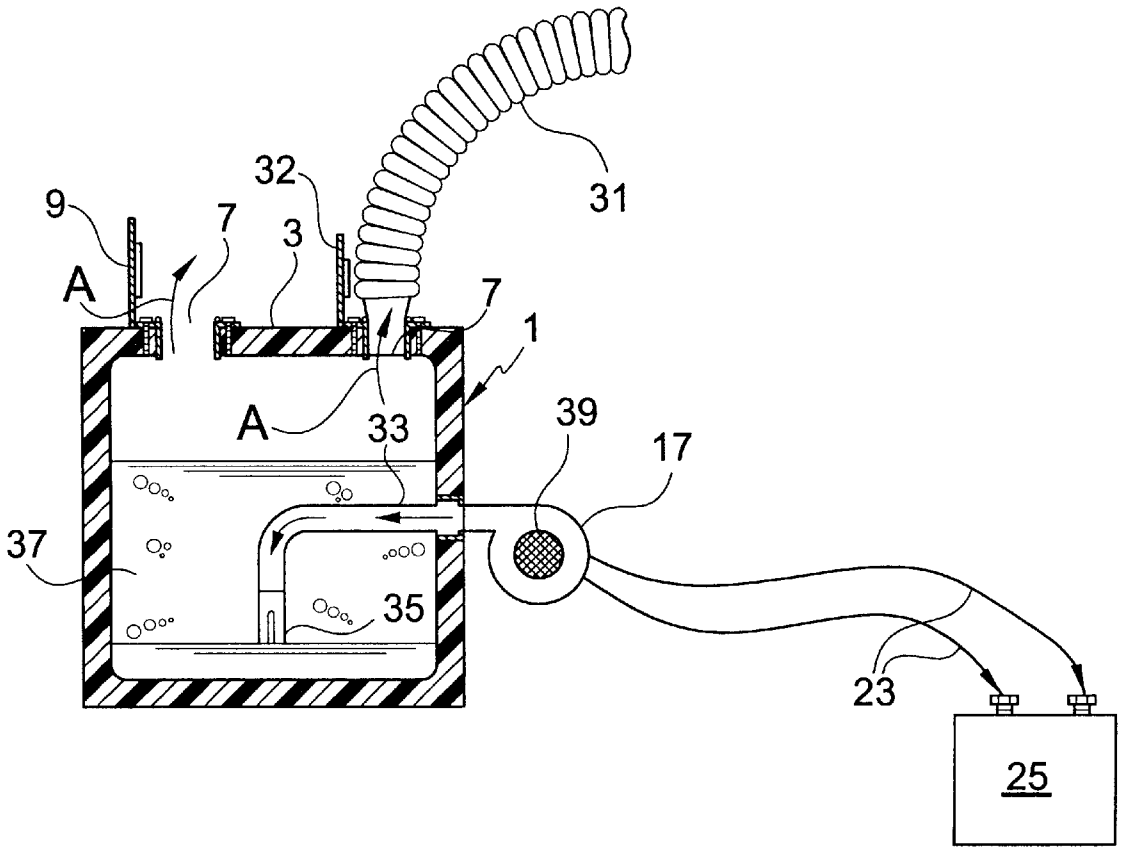
FIG. 2 is a cross section view through the mid portion of the container and lid as in FIG. 1 with an opened outlet and a conduit added to one of the two opened outlets.
Figure 3:
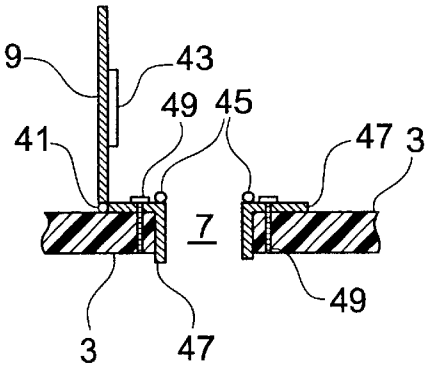
FIG. 3 is an enlarged cross sectional view of a lid outlet with the outlet opened.

FIG. 2 is a cross section view through a mid portion of the side 15 of the container 1 and lid 3, as shown in FIG. 1. In FIG. 2, the outlets of FIG. 1 are modified in that two of the outlets 7 are shown in opened positions with their respective covers opened. One particular outlet cover 32 is depicted in a raised or opened position. The outlet associated with raised cover 32 has a gas conduit or hose 31 (partially shown) connected to the associated opened outlet 7. Any of the other five outlets 7 could also have a similar hose, like hose 31, connected to it. The particular lid outlet selected to be connected with the hose 31 is the outlet which has the cover 32 (see FIG. 1) and is located nearest the top of the mounted fan 17.

The sides of the container 1 and the lid 3 are made of a thermal insulating material, such as a foam plastic material. A conduit 33 is connect to the fan 17 and extends into the insulated interior of the container. A downwardly facing end segment on conduit 33 has an open end 35. The end 35 is located within a cooling medium 37, such as ice. As the air from fan 17 is forced into the medium 37, the airflow exits from the end 35 and is injected into the cooling medium 37. After the cooling of air takes place, the cooled and moist air exits from any of the opened outlets 7 in the direction of the arrows A.

One or more of the six outlets 7 may have their covers 9 opened, as shown, to discharge this cooled air. If a hose or other conduit 31 (partially shown) is connected to an opened outlet, the opposite opened hose end may be moved and directed to any desired location to discharge the cooled air. Also shown in this view is a protective fan screen 39 used to screen out insects and debris from entering along with the air drawn into the interior of the fan 17 and then into the container 1.

FIG. 3 is an enlarged cross sectional view of one of the outlets 7 with the outlet covers 9 in an opened or raised position. Only a portion of the lid 3 is shown in FIG. 3. A conventional hinge spring 41 normally maintains the cover in a closed position to cover the outlet, however, when the cover is pivoted to an opened position, it remains opened due to the action of a conventional cam surface (not shown) located on the hinge base which works against the closing action of the spring. By depressing the cover, the opening force of the cam is overcome, and the spring pulls the cover down.

Also shown in FIG. 3, is a cover gasket 43 fixed to the inside surface of the cover 9 (or cover 32) that engages a gasket seal 45 that extends around the outlet opening 7. The remaining structure 47 is the holding body used to support the cover and part of it extends into and around the outlet 7. Fasteners 49, for example, can be a bolt and flat head washer which extend through the structure 47 and the lid 3 to secure the structure 49 and the cover 9 to the surface of the lid 3.

Figure 4:
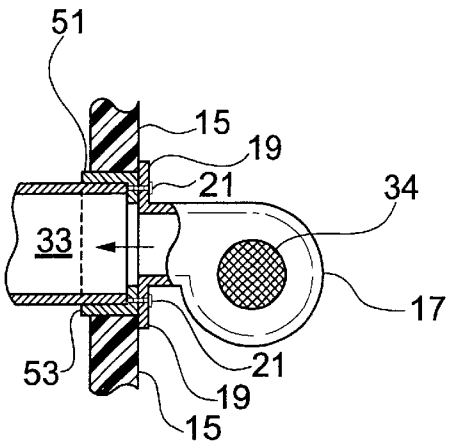
FIG. 4 shows how the blower is attached to the container side.

FIG. 4 shows how the fan 17 or blower is attached to a back side wall 15 of the container 1. A circular outlet 51, in wall 15, has a fitting collar 53 shaped to fit within the outlet. The exterior flange 19 from the fan 17 has fasteners 21 extending through the flange and into the collar 53 to retain the flange 19 and fan 17 to the wall 15. External ambient air enters through the screen 39 into the interior of the fan 17 where it is propelled into the tubular extension 33 within the container as shown in FIG. 2.

Figure 5:
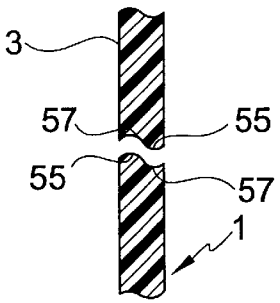
FIG. 5 is a cross section view of the mating surfaces between the lid and the container.

FIG. 5 is a view of the mating surfaces between the engaged, or contacting, edges of the lid 3 and the edges of the top opening of the container 1. The engaged surface edges on both the container and the lid are alternately convex 55 and concave 57 to provide for an air tight seal around the top opening of the container when the lid 3 is placed down (closed) to engage the container edges.

Figure 6:
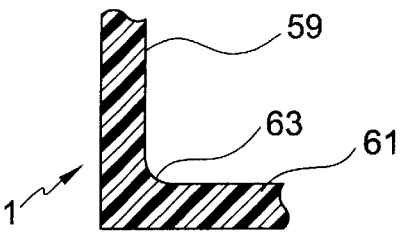
FIG. 6 shows a cross sectional view of an inside container corner.

FIG. 6 shows an inside interior corner of the container 1 in cross section. The container inside wall 59 meets the inside bottom 61 of the container. A curved corner 63, which is slightly concave, is located at the interior side where the wall and bottom meet. This corner 63 prevents ice from accumulating at that particular location and makes the cleaning of the container 1 easier.

Figure 7:
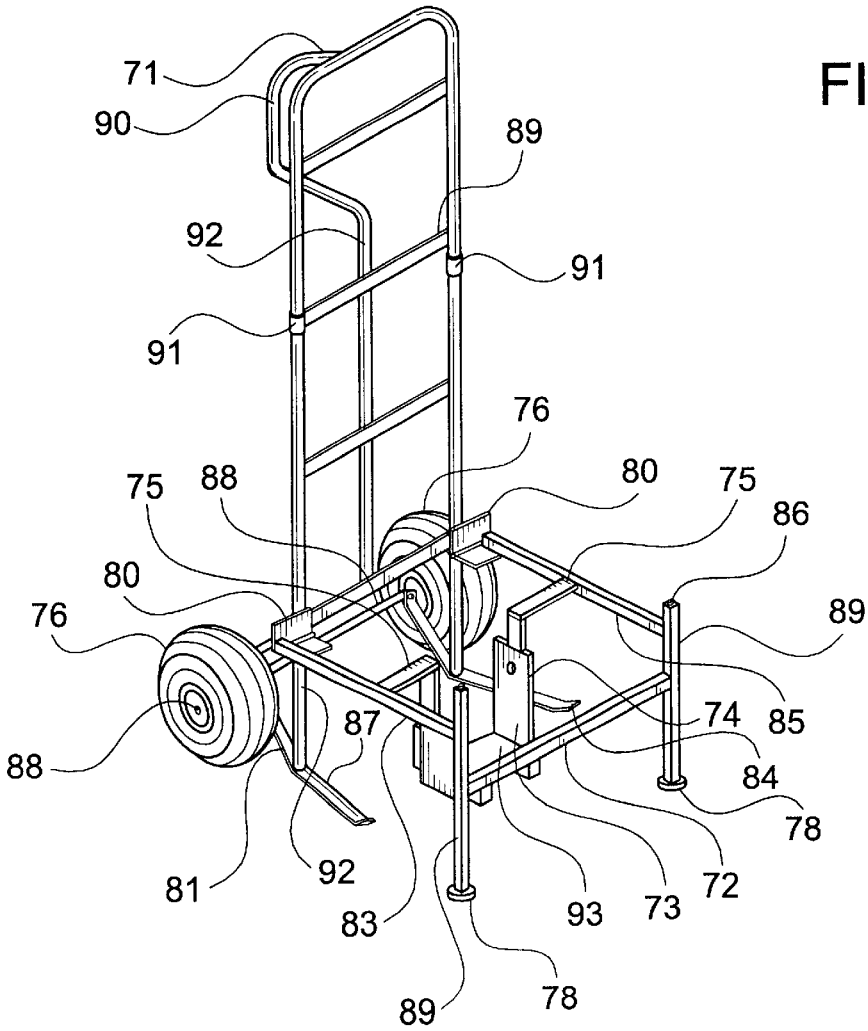
FIG. 7 is a perspective view of the cart used with the present invention.
Figure 8:
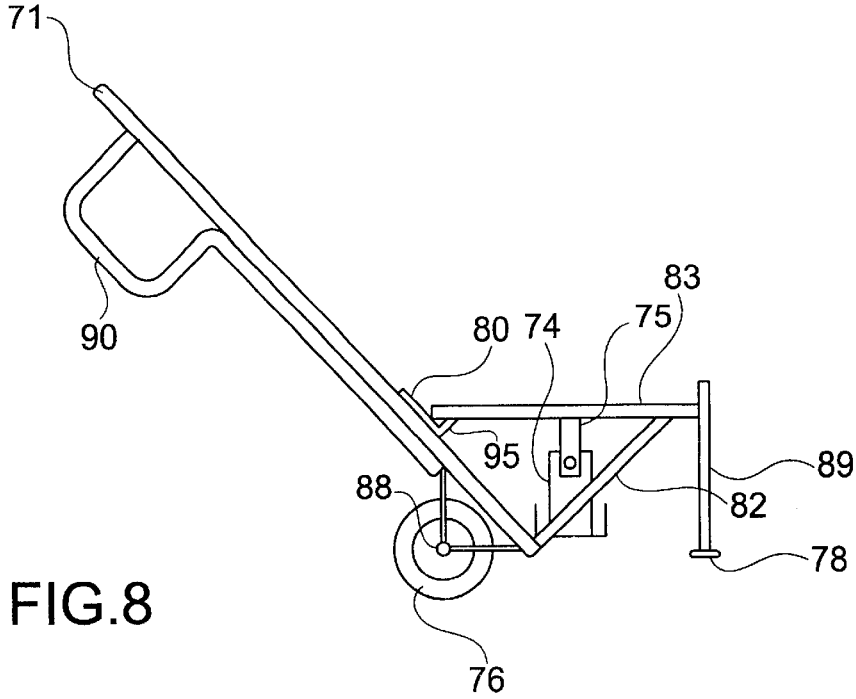
FIG. 8 is a side view of the cart used with the present invention.

FIGS. 7 and 8 show a dolly or cart that can be used to transport the container 1. The cart has a back comprising vertical rods 91 and cross rods 89 which are secured together in any conventional manner. A handle 90 with a supporting rod 92 is secured to the back and can be used to maneuver the cart. Attached to the back is a horizontal platform comprising a pair of horizontal rods 83 which will support the container 1. Attached to the front portion of the horizontal platform is a pair of front legs 89, and a cross brace 72 secured there between. Each of the legs 89 has a support pad 78 secured thereto.

The cart also has a pair of back legs 92, which are secured adjacent wheels 76. The wheels 76 are supported by an axle 88 which is secured to the cart in any conventional manner. The back legs each have a brace, comprising supports 81, 87, attached thereto to provide stability to the cart when it is in the upright position as shown in FIG. 7.

Mounted below the horizontal rods 83 is a pivoting battery carrier which will support the battery 25 used to operate the fan 17. The battery carrier has a first arm 75 attached to each of the horizontal rods 83 in any conventional manner. The arms 75 are L-shaped with a horizontal and vertical section. Attached to the vertical section of the arms 75 is a U-shaped bracket comprising two vertical supports 74 and a bottom support 93. The vertical supports 74 are attached to the arms 75 so the vertical supports 74 and the bottom support 93 are free swinging with respect to the arms 75. This will keep the battery level no matter what orientation the cart is in.

As shown in FIG. 8, the horizontal bars 83, upon which the container 1 rests, are hinged at 95 to the bars 91.

Therefore, when the cart is in the upright position, as shown in FIG. 7, the front legs or bars 89 will keep the bars 83, and the container if it is resting on the bars, level. That is, the top and bottom of the container will be parallel with the ground the cart is resting on. When the cart is tilted into the travel position, shown in FIG. 8, the bars 83, and the container, if it is resting on the bars, will remain in a level condition, since the bars 83 will pivot about the hinge 95, until the bars 82 contact the underside of the bars 83. This will keep the container 1 level at all times and will prevent any water, from melting ice, from spilling.

The invention was designed using a modified fully insulted ice chest. Other containers specifically designed as outlined above could also be used. Within the container the cooling medium selected was ice. Clearly, ice cubes, crushed ice, block ice and cold water could also be used for the cooling medium. Any other safe cold medium could conceivably be used.

The electric power source 25 selected for running the fan 17 was a 12 volt rechargeable battery. Any other safe 12 volt DC source of power with sufficient capacity could also be used. In operation, 376 cubic feet per minute of air was generated by a squirrel case blower fan. Clearly, this could varied along with the battery capacity as desired and needed.

Once the cooled air is discharged from the opened end of hose 31 it may be directed as desired. For example, on a hot day the discharged jet of cool moist air could be used to cool football players on the sidelines. Clearly other outdoor and indoor sports could also employ the same principles to cool the players. This cooling would help prevent heatstroke, restore the player's efficiency and avoid exhaustion.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. The combination of a portable air conditioner and a cart for mounting and transporting the air conditioner comprising:

a container having an air cooling medium within the container, a lid on said container to permit access to the interior of the container, a plurality of outlets in said lid, said plurality of outlets having means to open and close the outlets to allow the movement of air from within the container, said means to open and close the outlets comprising covers normally maintained closed, means for forcing air into the container and through said air cooling median, and through at least one of said plurality of outlets, when at least one of said plurality of outlets is open, said means for forcing air into the container and through at least one of said plurality of outlets being an electrically operated fan, a self contained power source for said electrically operated fan mounted on a side of the container, at least one flexible conduit connected to one of said plurality of opened outlets to direct the flow of air therefrom, a cart for mounting and transporting the container and self contained power source, and said cart having means for maintaining the mounted container and self contained power source substantially parallel to the surface over which the cart is moved.

2. A portable air conditioner comprising:

a container having an air cooling medium within the container, a lid on said container to permit access to the interior of the container, a plurality of outlets in said lid, said plurality of outlets having means to open and close the outlets to allow the movement of air from within the container, each of said plurality of outlets normally maintained closed by a cover, said cover being openable and closable, flexible conduit means connectable to any of the opened outlets for directing air therefrom to a desired location, means for forcing air into the container and through said air cooling median, and through at least one of said plurality of outlets, when at least one of said plurality of outlets is open, said means for forcing air into the container and through at least one of said plurality of outlets being an electrically operated fan, and a self contained power source for said electrically operated fan.

3. The portable air conditioner as claimed in claim 2, wherein said flexible conduit means comprises at least two separate conduits each individually connectable to any of the opened plurality of outlets.

* * * * *